United States Patent [19]

Kamata

[11] Patent Number: 5,062,162

[45] Date of Patent: Nov. 5, 1991

[54] SHIELD PLATE-MOUNTING STRUCTURE IN HELMET

[75] Inventor: Eitaro Kamata, Tokyo, Japan

[73] Assignee: Shoei Kako Kabushiki Kaisha, Tokyo, Japan

[21] Appl. No.: 667,918

[22] Filed: Mar. 11, 1991

[30] Foreign Application Priority Data

Oct. 24, 1990 [JP] Japan ..... 2-286562

[51] Int. Cl.[5] ..... A42B 1/08

[52] U.S. Cl. ..... 2/424; 2/425

[58] Field of Search ..... 2/9, 410, 422, 424, 2/425

[56] References Cited

U.S. PATENT DOCUMENTS 4,305,160 12/1981 Sundahl ..... 2/424
4,748,696 6/1988 Fohl ..... 2/424
4,866,792 9/1989 Arai ..... 2/424

FOREIGN PATENT DOCUMENTS 1560723 2/1980 United Kingdom ..... 2/424
2087221 5/1982 United Kingdom ..... 2/425

*Primary Examiner*—Werner H. Schroeder
*Assistant Examiner*—Michael A. Neas
*Attorney, Agent, or Firm*—Armstrong, Nikaido, Marmelstein, Kubovcik, & Murray

[57] ABSTRACT

A structure for mounting a shield plate on a mounting base plate on a cap body of a helmet for rotation or pivotal movement between fully opened and closed positions. The mounting base plate and the shield plate are provided with two bayonet mechanisms having their disconnecting positions not aligned with each other in the rotational direction of the shield plate. The shield plate can be rotatably and reliably mounted on the cap body by sequentially bringing the bayonet mechanisms into the state of connection.

4 Claims, 8 Drawing Sheets

SHIELD PLATE-MOUNTING STRUCTURE IN HELMET

BACKGROUND OF THE INVENTION

1. Field of the Invention

The field of the present invention is shield plate-mounting structures for mounting a shield plate to a mounting base plate secured to an outer side surface of a cap body such that the plate can be pivoted or rotated between a fully opened position in which a window in the cap body is fully opened and a fully closed position in which the window is fully closed.

2. Description of the Prior Art

In the conventional shield plate mounting structure of this type, a machine screw or a cover is used for preventing the removal of the shield plate from the mounting base plate (see Japanese Utility Model Publication No. 15314/88).

In general, in the helmet, the shield plate may be replaced in some cases by one of a clear type or a sun-shade type according to the preference of a user or the service condition. With the above prior art structure, the machine screw or the cover must be detached at every time of such replacement. Thus, not only the operation therefor is troublesome, but also it is feared that the machine screw may be lost, or the cover may be fallen and damaged.

SUMMARY OF THE INVENTION

Accordingly, it is an object of the present invention to provide a shield plate mounting structure wherein a shield plate can be mounted to a mounting base plate without resorting to screws such as machine screws and covers and moreover, the separation of the shield plate can be reliably prevented in a normal service condition.

To achieve the above object, according to the present invention, there is provided a shield plate mounting structure in a helmet for mounting a shield plate to a mounting base plate secured to an outer side surface of a cap body such that the shield plate is turnable between a fully opened position in which a window of the cap body is fully opened and a fully closed position in which the window is fully closed, the structure comprising:

a cylindrical support provided on one of the mounting base plate and the shield plate;

a pivot provided on the other of the mounting base plate and the shield plate, the cylindrical support and the pivot being capable of being relatively turnably fitted with each other; and a first bayonet mechanism between the mounting base plate and the shield plate for separably connecting the mounting base plate and the shield plate through a relative pivotal movement therebetween;

a second bayonet mechanism provided between the mounting base plate and the shield plate at a position radially outwardly of the first bayonet mechanism for separably connecting the mounting base plate and the shield plate through a relative pivotal movement therebetween;

wherein separating positions of the first and second bayonet mechanisms are set at first and second different turning positions of the shield plate; and wherein the shield plate is provided with a resilience permitting a predetermined deformation thereof for disconnection of the second bayonet mechanism in the second rotational position.

With the above construction, in mounting the shield plate, it is first urged at its first rotational position toward the mounting base plate, thereby fitting the cylindrical support and the pivot with each other to bring the first bayonet mechanism into a connectable state. At this time, the second bayonet mechanism is incapable of being connected and hence, a resilient deformation is necessarily provided to the shield plate by the action of such urging force. If the shield plate is then rotated or pivoted to the second rotational position, the first bayonet mechanism is brought into a connected state, while the bayonet mechanism is automatically brought into a connectable state by the action of a deformation restoring force of the shield plate. The first and second bayonet mechanisms can be sequentially brought into their connected states by such simple operation. This provided the cooperation of both the bayonet mechanisms in which their disconnected positions are not aligned with each other, i.e., even if one of the bayonet mechanisms is in its disconnectable state, the other bayonet mechanism is in its connected state and inhibits the disconnection of the one bayonet mechanism, thereby ensuring that the shield plate can be reliably held on the mounting base plate in the normal service condition. Moreover, the use of no screw or cover for such holding largely contributes to simplification of the structure.

The above and other objects, features and advantages of the invention will become apparent from a reading of the following description of the preferred embodiments, taken in conjunction with the accompanying drawings.

BRIEF DESCRIPTION OF THE DRAWINGS

Drawings illustrate one embodiment of the present invention, wherein.

DESCRIPTION OF THE PREFERRED EMBODIMENTS

The present invention will now be described by way of one embodiment in connection with the accompanying drawings.

Figure 1:
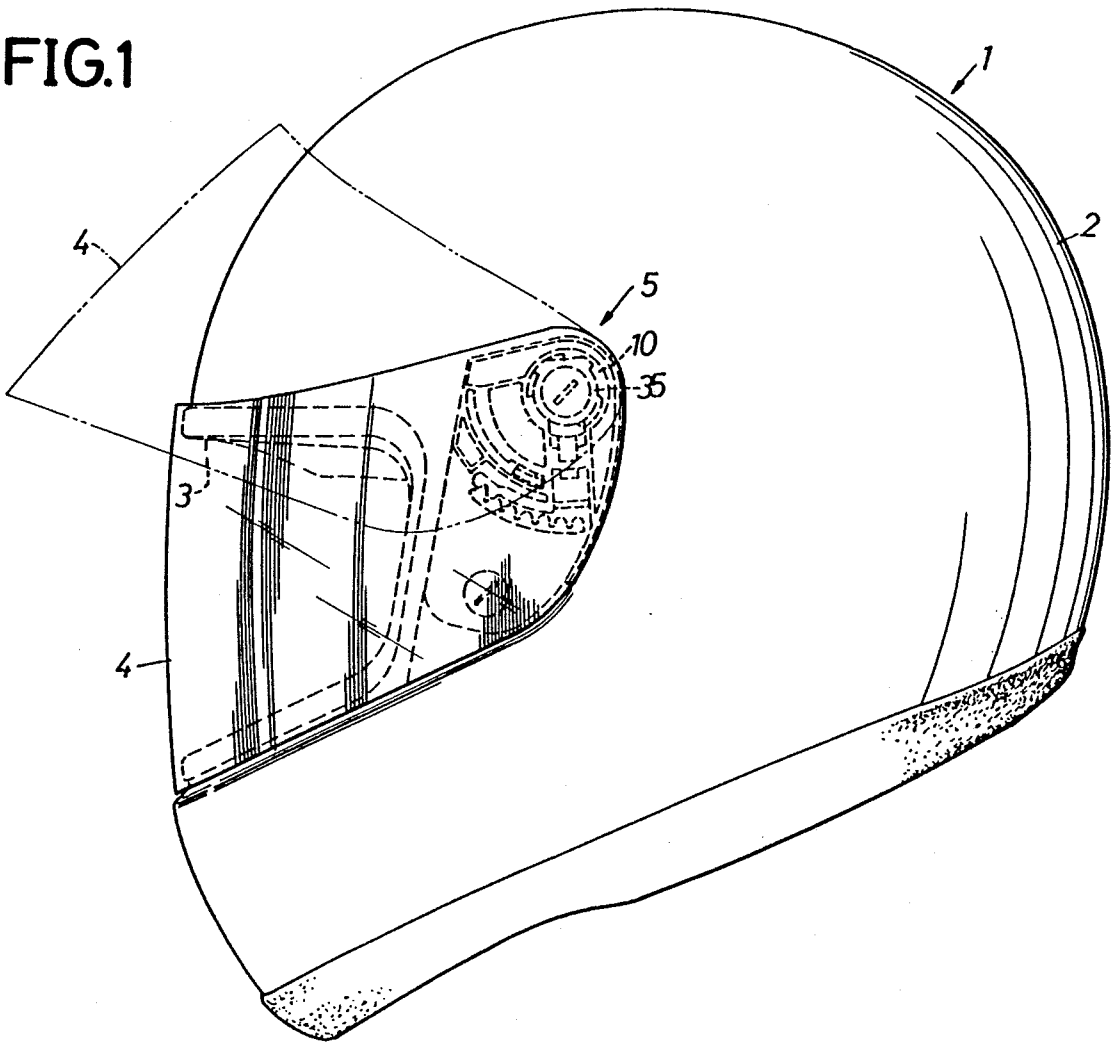
FIG. 1 is a side view of a helmet with a shield plate fully closed.

Referring first to FIG. 1, a shield plate 4 is vertically pivotally mounted at its left and right opposite ends to left and right oppsite walls of a cap body 2 of a full-face type helmet 1 by a mounting structure 5 according to one embodiment of the present invention. The entire shield plate 4, including the opposite ends, is formed from a material such as a transparent or light-transmittable synthetic resin.

Figure 2:
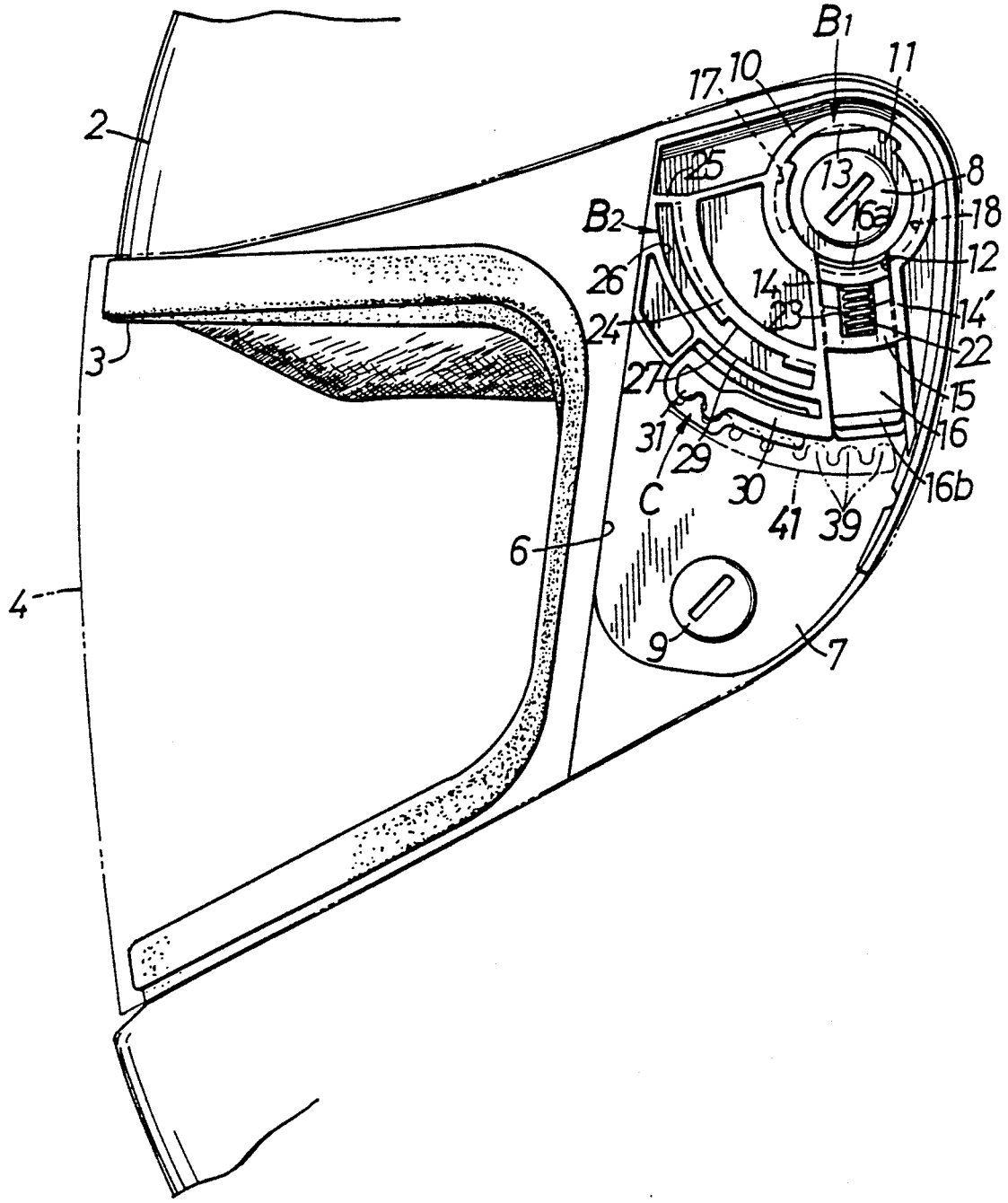
FIG. 2 is an enlarged side view of an essential portion of the helmet with the shield plate removed.
Figure 3:
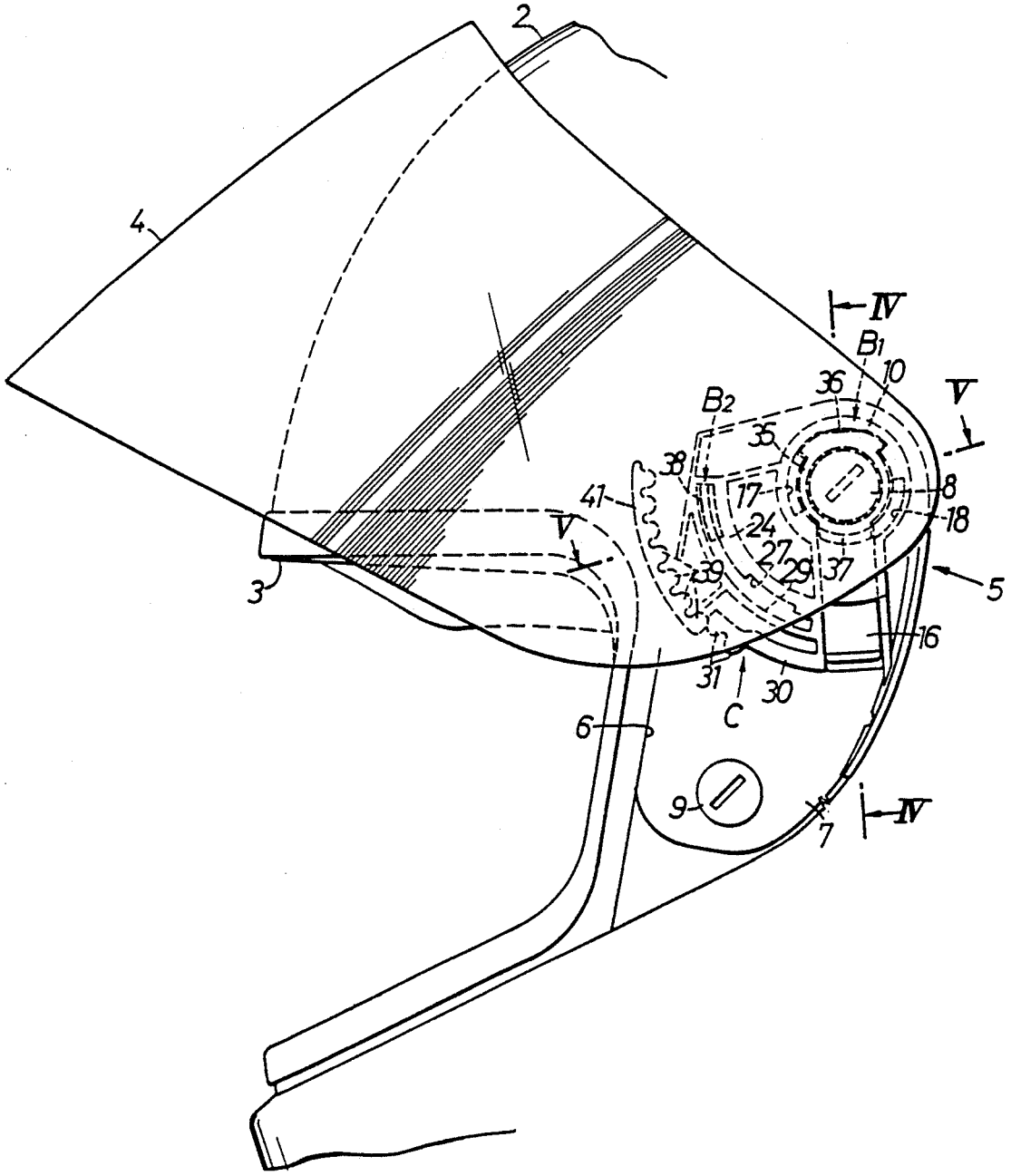
FIG. 3 is an enlarged side view of the essential portion of the helmet with the shield plate fully opened.
Figure 4:
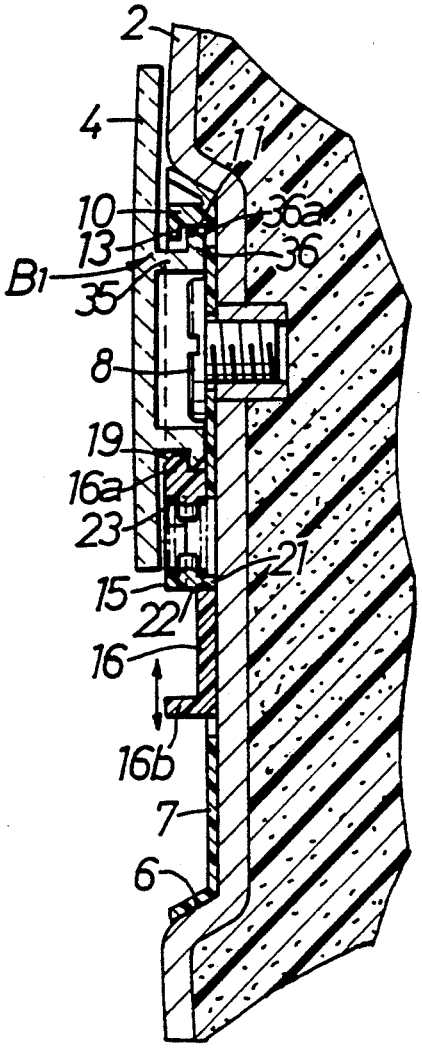
FIGS. 4 and 5 are sectional views taken along lines IV—IV and V—V in FIG. 3, respectively.

The mounting structure 5 will be described in connection with FIGS. 2 to 8. As shown in FIG. 2 and 4, a shallow recess 6 is defined in each of left and right sides of the cap body 2, and a mounting base plate 7 of synthetic resin is secured at two, upper and lower points thereof to a bottom of the recess 6 by machine screws 8 and 9.

As shown in FIGS. 2 to 6, a cylindrical support 10 is integrally formed on a surface of the mounting base plate 7 to surround the upper machine screw 8. A first wider notch 11 is provided at an upper portion of an inner wall of the cylindrical support 10, while a second narrower notch 12 is provided at a lower portion of the inner wall, and a small canopy-shaped projection 13 (see FIG. 4) is formed on an upper edge at a central portion of the first notch 11. Further, the inner wall of the cylindrical support 10 is provided with a first locking groove 17 extending downwardly from a front end of the nocth 11, and a second locking groove 18 extending upwardly from a rear end of the second notch 12.

A pair of guide walls 14 and 14' are projectingly provided on the surface of the mounting base plate 7 to extend straightly downwardly from the cylindrical support 10 with the second notch 12 sandwiched therebetween, and have their middle portions interconnected by a connecting wall 15.

A temporary locking member 16 is disposed between the guide walls 14 and 14' and guided in vertical sliding movement by the guide walls 14 and 14'. The temporarily locking member 16 is provided at its upper end with a pawl **16*a* facing the second notch 12 and bent toward a bottom of the cylindrical support 10, and at its lower end with a knob 16*b* rising outwardly of the mounting base plate 7. An upper edge at a leading end of the pawl 16*a* is formed into a slant 19 (see FIG. 4**).

As shown in FIG. 4, the temporary locking member 16 is further provided with a longitudinally long elongated hole 22 into which a projection 21 of the connecting wall 15 is inserted, so that the operative position of the temporary locking member 16 is restrained by abutment of the projection 21 against a lower end wall of the elongated hole 22, and a releasing position of the temporary locking member 16 in which the pawl **16*a* is permitted to be retreated from the cylindrical support 10 is restrained by abutment of the pawl 16*a* against the connecting wall 15. A coil spring 23 is mounted in a compressed manner between the temporary locking member 16 and the connecting wall 15 for biasing the temporary locking member 16** toward the operative position.

Referring again to FIGS. 2 to 6, the mounting base plate 7 further has a pair of inner and outer arcuate projecting walls 24 and 29 formed forwardly of the guide wall 14 and concentric with and larger in diameter than the cylindrical support 10, and a locking groove 26 is defined between the projecting walls 24 and 29. The locking groove 26 has an L-shaped cross section with its bottom bent toward the inner projecting wall 24, and a notch 27 (see FIG. 8) is provided in the inner projecting wall 24, so that a portion of such bent bottom is opened.

An upper end of the locking groove 26 is occluded by a rib 25 connecting three components, the projecting walls 24 and 29 and the cylindrical support 10, while a lower end of the locking groove 26 is occluded by the guide wall 14.

Further, the mounting base plate 7 is provided with a resilient arm 30 extending forwardly from the guide wall 14 radially outside the projecting wall 29. The resilient arm 30 includes a single click tooth or a plurality of click teeth 31 on an outer face of a free end thereof.

A pivot 35 is integrally formed on an inner surface of the shield plate 4 at each of left and right ends thereof and adapted to be loosely fitted into the cylindrical support 10.

A first 36 and a second collor-shaped locking pawl 37 are formed around an outer periphery of the pivot 35 and adapted to engage the first and second locking grooves 17 and 18 through the first and second notches 11 and 12, respectively. Outer peripheral edges of the locking pawls 36 and 37 are formed into slants **36*a* and 37*a***, respectively.

The first and second locking pawls 36 and 37 of the pivot 35 as well as the first and second notches 11 and 12 of the cylindrical support 10 and the first and second locking grooves 17 and 18 constitute a first bayonet mechanism B1 for separably connecting the mounting base plate 7 and the shield plate 4 to each other.

Further, the shield plate 4 is integrally provided, at each end thereof, with a locking pawl 38 adapted to engage the locking groove 26 through the nocth 27, and with an arcuate projection wall 41 which has a large number of click teeth 39, 39—cooperating with the click teeth 31 of the resilient arm 30.

Figure 5:
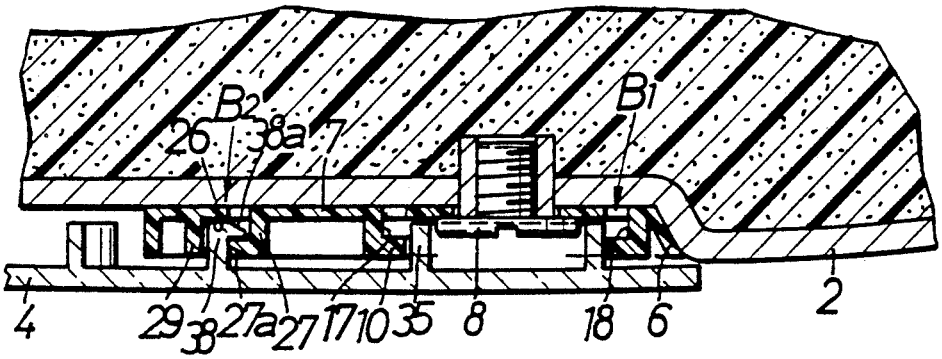
Figure 5A:
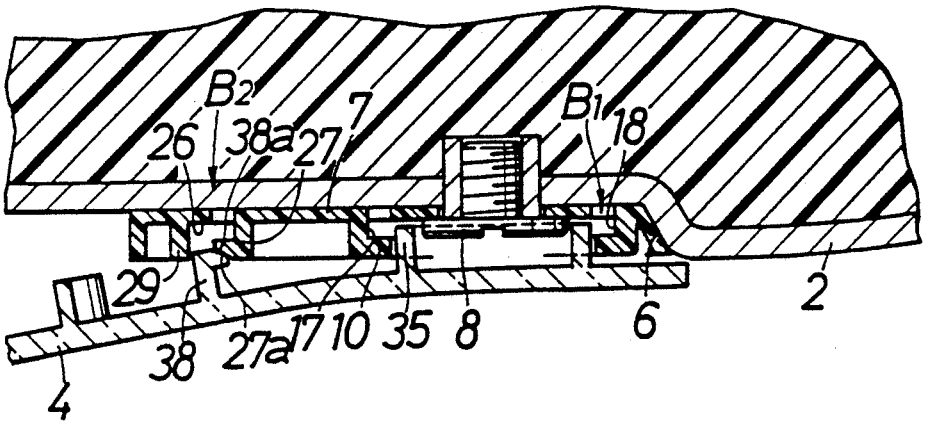
FIG. 5A is a sectional view similar to FIG. 5 but when a first bayonet mechanism is in its temporarily locked state and a second bayonet mechanism is in its non-connected state.
Figure 6:
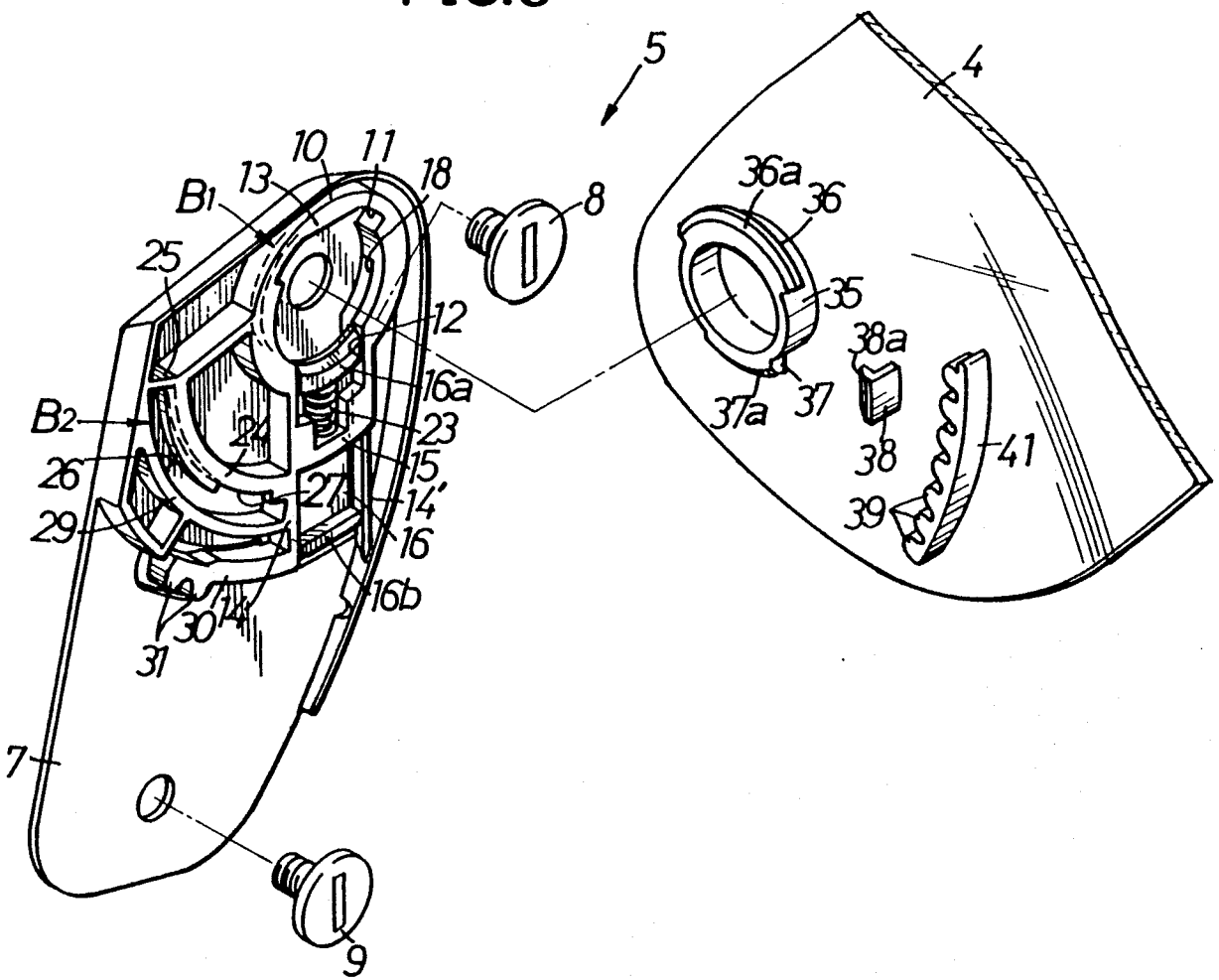
FIG. 6 is a exploded perspective view of a shield plate mounting structure.
Figure 7:
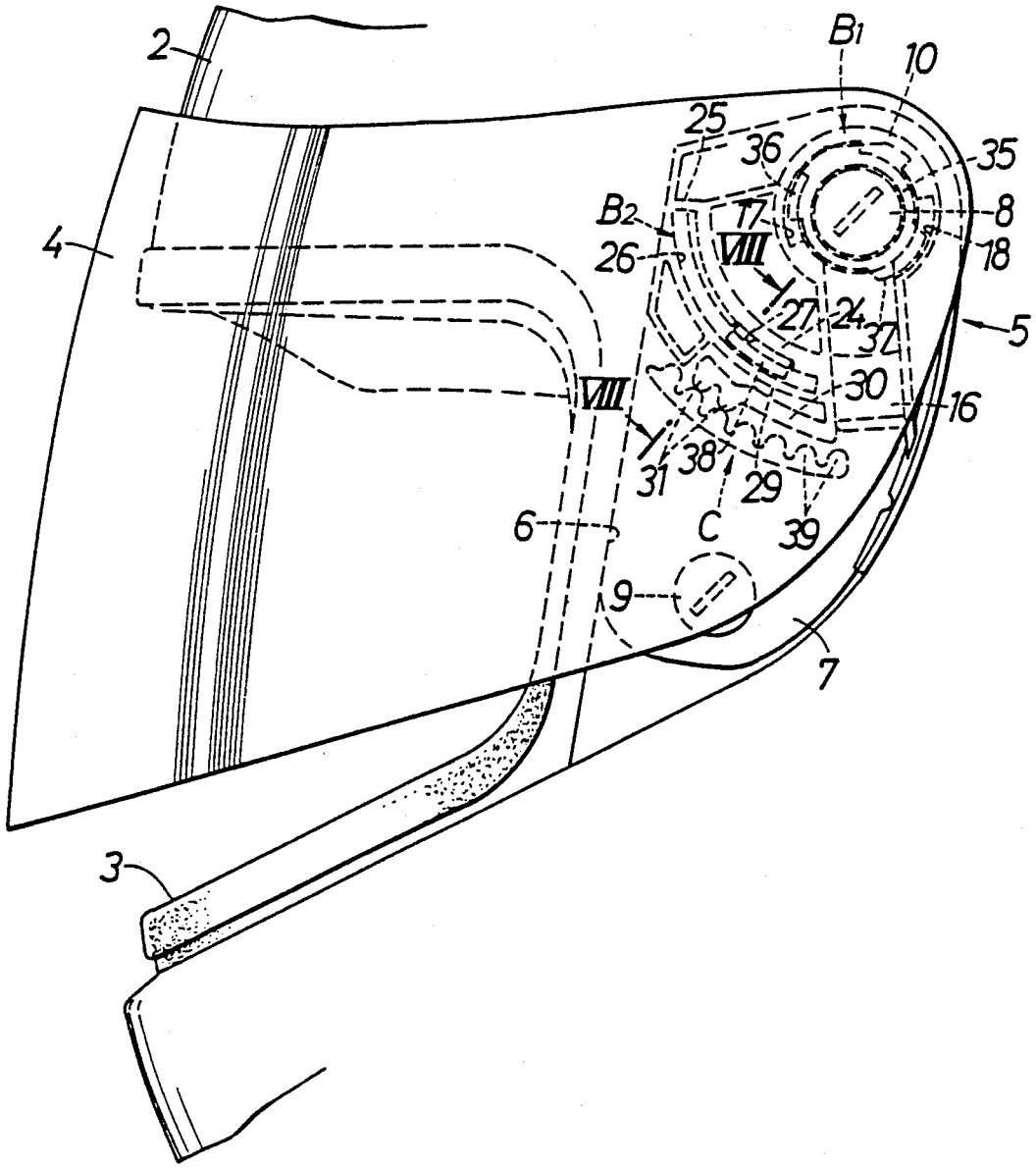
FIG. 7 is an enlarged side view of the essential portion of the helmet with the shield plate in a moderately opened state in which the shield plate can be separated by the second bayonet mechanism.
Figure 8:
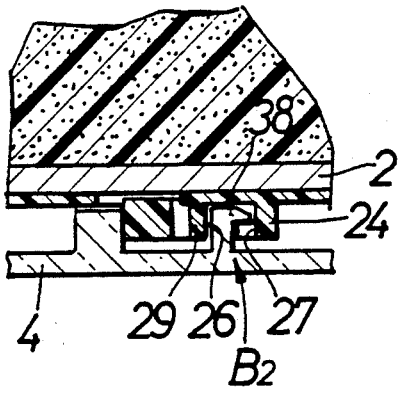
FIG. 8 is a sectional view taken along a line VIII—VIII in FIG. 7.

A slant **38*a* is provided on one side of a leading end of the locking pawl 38, and the leading end of the locking pawl 38 can slightly enter into the locking groove 26, even when the locking pawl 38 is not in an engaging relation to the locking groove 26** (see FIG. 5A).

The locking groove 26 having the notch 27 in the mounting base plate 7 and the locking pawl 38 of the shield plate 4 constitute a second bayonet mechanism B2 for separably interconnecting the mounting base plate 7 and the shield plate 4, and the resilient arm 30 having the click tooth or teeth 31 and the large number of click teeth 39, 39—constitute a click stop mechanism C which provides a multi-stage stop position to the shield plate 4 within a sphere of pivotal movement between a fully opened position and a fully closed position.

The foregoing ensures that the fully opened position of the shield plate 4 is restrained by mating of the locking pawl 38 with an upper end wall of the locking groove 26, i.e., the rib 25 and in this fully opened position, the first bayonet mechanism B1 is capable of being disconnected. That is, the first and second locking pawls 36 and 37 can be aligned with the first and second notches 11 and 12, respectively. Also, the second bayonet mechanism B2 is capable of being disconnected at a moderately opened position different from the fully opened position of the shield plate 4, particularly at a middle position between two adjacent predetermined stop positions restrained by the click stop mechanism C. That is, the locking pawl 38 can be aligned with the notch 27 (see FIGS. 7 and 8).

It should be noted that the separation of the locking pawl 38 from the notch 27 is conducted by deflecting the shield plate 4 outwardly and thus, the shield plate 4 is provided with a resilience sufficient to withstand such deflection.

The operation of this embodiment will be described below.

To mount the shield plate 4 on the cap body 2, first, centers of the pivot 35 and the cylindrical support 10 are aligned with each other in the fully opened position of the shield plate 4, and as a result, the first and second locking pawls 36 and 37 of the first bayonet mechanism B1 reach positions in which they are capable of entering into the first and second notches 11 and 12 of the cylindrical support 10. Thereupon, if the outer side of the end of the shield plate 4 is strongly urged toward the mounting base plate 7 so that the pivot 35 is fitted into the cylindrical support 10, the first locking pawl 36 enters into the first notch 11, and while the slant 36*a* is being slided, the first locking pawl 36 engages the small projection 13. On the other hand, the locking pawl 37, while entering into the second notch 12, urges the slant 19 of the temporary locking member 16 by the slant 37*a*, thereby once retreating the temporary locking member 16 against a biasing force of the spring 23 to an inoperative position. If the second locking pawl 37 is completely fitted into the second notch 12, the temporary locking member 16 is returned to the operative position by the action of the biasing force of the spring 23, so that the pawl 16*a* is engaged with the second locking pawl 37. In this manner, the first bayonet mechanism B1 is brought into a temporarily locked state.

At this time, the second bayonet mechanism B2 is in a non-connectable state because of misalignment between the locking pawl 38 and the notch 27 and therefore, the shield plate 4 is necessarily deflected by the above-described urging force, as shown in FIG. 5A.

If the shield plate 4 is then rotated or pivoted downwardly about the pivot 35, the first and second locking pawls 36 and 37 engage the first and second engage grooves 17 and 18 in the cylindrical support 10, respectively, and thus, the second bayonet B1 is brought into the connecting state. When the shield plate 4 is rotated or pivoted to a point where the notch 27 of the second bayonet mechanism B2 is aligned with the locking pawl 38, the locking pawl 38 is automatically engaged into the notch 27 under the influence of the deflection-restoring force of the shield 4 and at the same time, the click stop mechanism C enters the operative state.

Accordingly, in a normal service condition in which the shield plate 4 can be rotated or pivoted within the sphere between the fully opened and closed positions, the locking pawl 38 is thereafter maintained at a position of engagement with the locking groove 26 by the action of the first bayonet mechanism B1 and under the influence of the resilience of the shield plate 4 and cannot be separated from the notch 27.

Especially, in the fully opened position of the shield plate 4 restrained by mating of the locking pawl 38 with the upper end wall 25 of the guide wall 26, the locking pawl 38 and the notch 27 are staggered from each other and hence, even if the shield plate 4 is deflected outwardly by the action of a shock force produced when the shield plate is suddenly fully opened, or a strong flapping force provided by a travelling wind during travelling of a motorcycle at a high speed with the shield plate 4 in a fully opened condition, the locking pawl 38 cannot be separated from the locking groove 26, i.e., the connected state of the second bayonet mechanism B2 is insured. In such a fully opened state of the shield plate 4, the first bayonet mechanism B1 is in a state capable of being disconnected, but such a disconnection is inhibited by the second bayonet mechanism B2 which is in its connected state, as described above.

Even in the multi-stage stop positoin of the shield plate 4 restrained by the click stop mechanism C, the second bayonet mechanism B2 cannot be disconnected, because the locking pawl 38 and the notch 27 are stageerred from each other.

In this way, the shield plate 4, in its normal service state, is reliably held on the mounting base plate 7 by cooperation of the first and second bayonet mechanism B1 and B2.

When the shield plate 4 is to be removed from the cap body 2, the reverse procedure may be conducted. More specifically, first, in the predetermined rotational position thereof in which the locking pawl 38 is aligned with the notch 27, the shield plate 4 is deflected outwardly to separate the locking pawl 38 from the locking groove 26 through the notch 27 and is then rotated or pivoted to the fully opened position. In this manner, the second bayonet mechanism B2 is first disconnected.

In this case, although the locking pawl 38 has been separated from the locking groove 26, the leading end thereof slightly projects into the locking groove 26 and hence, such projecting end abuts against the upper end wall of the locking groove 26, thereby recognizing the fully opened position of the shield plate 4 in which the first bayonet mechanism B1 can be disconnected.

Thereupon, the pawl 16*a* is separated from the second locking pawl 37 by putting a finger on the knob 16*b* to pull down the temporary locking member 16. If the end of the shield plate 4 is strongly pulled outwardly in this state, the first locking pawl 36 is forcedly separated from the small projection 13. In this manner, the end of the shield plate 4 is removed from the mounting base plate 7.

It should be noted that in attaching or detaching the shield plate 4, the mutual positional relationship between the individual parts of the mounting structure 5 can be visually observed through the shield plate 4, because the shield plate 4 is transparent or light-transmittable not only at its central portion but also at its left and right opposite ends, and thus, the attaching and detaching operation can be easily and precisely conducted. There is also a convenience that whether or not there is a trouble in the mounting structure 5 can be visually checked with the shield plate 4 remaining mounted.

It will be understood that the present invention is not limited to the full-face type helmet and is also applicable to other types, e.g., a jet type.

In addition, the disconnected position of the first bayonet mechanism B1 is not limited to the fully opened position of the shield plate 4 and in short, may be any position if it is staggered from the rotational position of the shield plate 4 in which the second bayonet mechanism B2 can be disconnected.

Further, the element of the mounting structure 5 on the side of the mounting base plate 7 in the above embodiment may be provided on the shield plate 4, while the element on the shield plate 4 may be provided on the mounting base plate 7.

What is claimed is:

1. A shield plate mounting structure in a helmet for mounting a shield plate to a mounting base plate secured to an outer side surface of a cap body such that the shield plate is turnable between a fully opened position in which a window of the cap body is fully opened and a fully closed position in which the window is fully closed, the structure comprising:

a cylindrical support provided on one of the mounting base plate and the shield plate;

a pivot provided on the other of said mounting base plate and said shield plate, said cylindrical support and said pivot being capable of being relatively turnably fitted with each other; and a first bayonet mechanism between said mounting base plate and said shield plate for separably connecting said mounting base plate and said shield plate through a relative pivotal movement therebetween;

a second bayonet mechanism provided between said mounting base plate and said shield plate at a position radially outwardly of said first bayonet mechanism for separably connecting said mounting base plate and said shield plate through a relative pivotal movement therebetween;

wherein separating positions of said first and second bayonet mechanisms are set at first and second different rotational positions of said shield plate; and wherein said shield plate is provided with a resilience permitting a predetermined deformation thereof for disconnection of the second bayonet mechanism in the second rotational position.

2. A shield plate mounting structure in a helmet according to claim 1, wherein the disconnecting position of said second bayonet mechanism is set at a rotational position other than the fully opened position of said shield plate.

3. A shield plate mounting structure in a helmet according to claim 1 or 2, further including a click stop mechanism provided between said mounting base plate and said shield plate for providing a multi-stage of stop positions to said shield plate within a range of pivotal movement between the fully opened and closed positions thereof, and wherein the disconnecting position of said second bayonet mechanism is set at an intermediate position between two adjacent ones of the predetermined stop positions of said shield plate restrained by said click stop mechanism.

4. A shield plate mounting structure in a helmet according to claim 1, further including a temporary locking member capable of maintaining and releasing a fitting state between said cylindrical support and said pivot, said temporary locking member being normally biased to a position of maintaining the fitting state between said cylindrical support and said pivot, said temporary locking member being movable to a position of releasing said fitting state.

* * * * *